US008047679B2

(12) United States Patent
Wu et al.

(10) Patent No.: US 8,047,679 B2
(45) Date of Patent: Nov. 1, 2011

(54) LED LAMP WITH 360-DEGREE ILLUMINATION

(75) Inventors: Chien-Jung Wu, Chung-Ho (TW); Tsung-Ting Sun, Chung-Ho (TW)

(73) Assignee: Edison Opto Corporation, Taipei (TW)

( * ) Notice: Subject to any disclaimer, the term of this patent is extended or adjusted under 35 U.S.C. 154(b) by 122 days.

(21) Appl. No.: 12/570,020

(22) Filed: Sep. 30, 2009

(65) Prior Publication Data

US 2011/0075412 A1 Mar. 31, 2011

(51) Int. Cl.
*F21V 21/00* (2006.01)

(52) U.S. Cl. ..... 362/249.02; 362/249.14; 362/240; 362/241

(58) Field of Classification Search ..... 362/240, 362/241, 294, 249.02, 249.18
See application file for complete search history.

(56) References Cited

U.S. PATENT DOCUMENTS 7,607,802 B2 * 10/2009 Kang et al. ..... 362/294

FOREIGN PATENT DOCUMENTS

JP 20020184209 * 6/2002
TW M306299 2/2007

* cited by examiner

*Primary Examiner* — Ali Alavi
(74) *Attorney, Agent, or Firm* — Chun-Ming Shih; HDLS IPR Services

(57) ABSTRACT

A LED lamp with 360-degree illumination includes a base, a first substrate, a stepped structure, a plurality of LEDs, and a cover. The first substrate is fixed on the base. The stepped structure is mounted on the first substrate. The stepped structure has a first annular frame connected to the first substrate, a second substrate connected to the first annular frame, and a second annular frame connected to the second substrate. The peripheral length of the second annular frame is smaller than that of the first annular frame. The plurality of LEDs is fixed to the first substrate and the second substrate and surrounds the first annular frame and the second annular frame respectively. With this arrangement, the LEDs can be arranged in a multi-storey stepped structure to generate an effect of 360-degree illumination. Also, the illumination range of the lamp can be increased.

16 Claims, 6 Drawing Sheets

LED LAMP WITH 360-DEGREE ILLUMINATION

BACKGROUND OF THE INVENTION

1. Field of the Invention

The present invention relates to a LED lamp, and in particular to a LED lamp with 360-degree illumination.

2. Description of Prior Art

Since light emitting diodes (LEDs) have advantages of low electricity consumption, environmental protection, long life, small volume and toughness, they have been widely used in various fields such as automobiles, communication industries or consumptive electronic appliances to replace traditional light sources. However, the lights emitted by the LEDs are concentrated in a certain range. Thus, manufacturers in this industry continue to develop a lamp with 360-degree illumination. For example, Taiwan Patent Publication No. M306299 discloses a lamp 100 with 360-degree illumination. As shown in FIG. 1, the center of a base 110 is provided with a post 120. The outer surface of the post 120 is provided with a plurality of LEDs 130 arranged in vertical lines, whereby the 360-degree illumination can be achieved.

However, in practice, such a structure still has some problems as follows. In order to achieve the required 360-degree illumination and brightness, it is necessary to increase the number of LEDs 130, which also increases the production cost and time for assembly. On the other hand, since there are a number of LEDs 130 that are arranged densely, the heat generated by the LEDs 130 cannot be dissipated sufficiently by the post 120. As a result, the working temperature of the LEDs 130 is so high that the life of the LEDs 130 will be deteriorated, which may increase the time and cost for maintenance.

Therefore, in order to solve the above-mentioned problems, the present Inventor proposes a reasonable and novel structure based on his deliberate research and expert experiences.

SUMMARY OF THE INVENTION

The present invention is to provide a LED lamp with 360-degree illumination, whereby all lateral surfaces of the lamp can have sufficient brightness to generate an effect of 360-degree illumination.

The present invention provides a LED lamp with 360-degree illumination, which includes: a base; a first substrate fixed on the base; a stepped structure mounted on the first substrate, the stepped structure having a first annular frame connected to the first substrate, a second substrate connected to the first annular frame, and a second annular frame connected to the second substrate, a peripheral length of the second annular frame being smaller than that of the first annular frame; and a plurality of LEDs fixed to the first substrate and the second substrate and surrounding the first annular frame and the second annular frame respectively.

In comparison with prior art, the present invention has advantageous features as follows:

(I) Since the present invention has a three-dimensional stepped structure and the plurality of LEDs is provided respectively on the first substrate, the second substrate and the third substrate of different heights, all lateral surfaces of the lamp have sufficient brightness to generate an effect of 360-degree illumination. Further, the three-dimensional illumination range of the lamp can be increased.

(II) In comparison with the LEDs in prior art being arranged densely in one surface, the LEDs of the present invention are arranged on a stepped surface, so that the LEDs of the present invention are distributed less densely. Thus, the heat generated by the LEDs can be conducted by the first annular frame and the second annular frame to the first substrate. In addition, with a heat sink adhered to the back surface of the first substrate, the present invention can generate a good effect of thermal conduction and heat dissipation. Therefore, the LEDs can be kept in a normal working temperature to extend the life of the LED lamp.

(III) Since reflective layers are provided on the external surfaces of the first annular frame and the second annular frame respectively, the lights emitted by the LEDs onto the adjacent reflective layer will be reflected by that reflective layer toward the outside of the lamp. In this way, the total brightness in the lateral direction of the lamp can be increased. In other words, in comparison with the prior art only using the lights emitted by the LEDs directly, the present invention utilizes reflected lights as a portion of illumination, so that the present invention can use a smaller number of LEDs than the prior art does. Thus, the production cost and time for assembly can be reduced.

DETAILED DESCRIPTION OF THE INVENTION

The characteristics and technical contents of the present invention will be described with reference to the accompanying drawings. However, the drawings are illustrative only but not used to limit the present invention.

Figure 1:
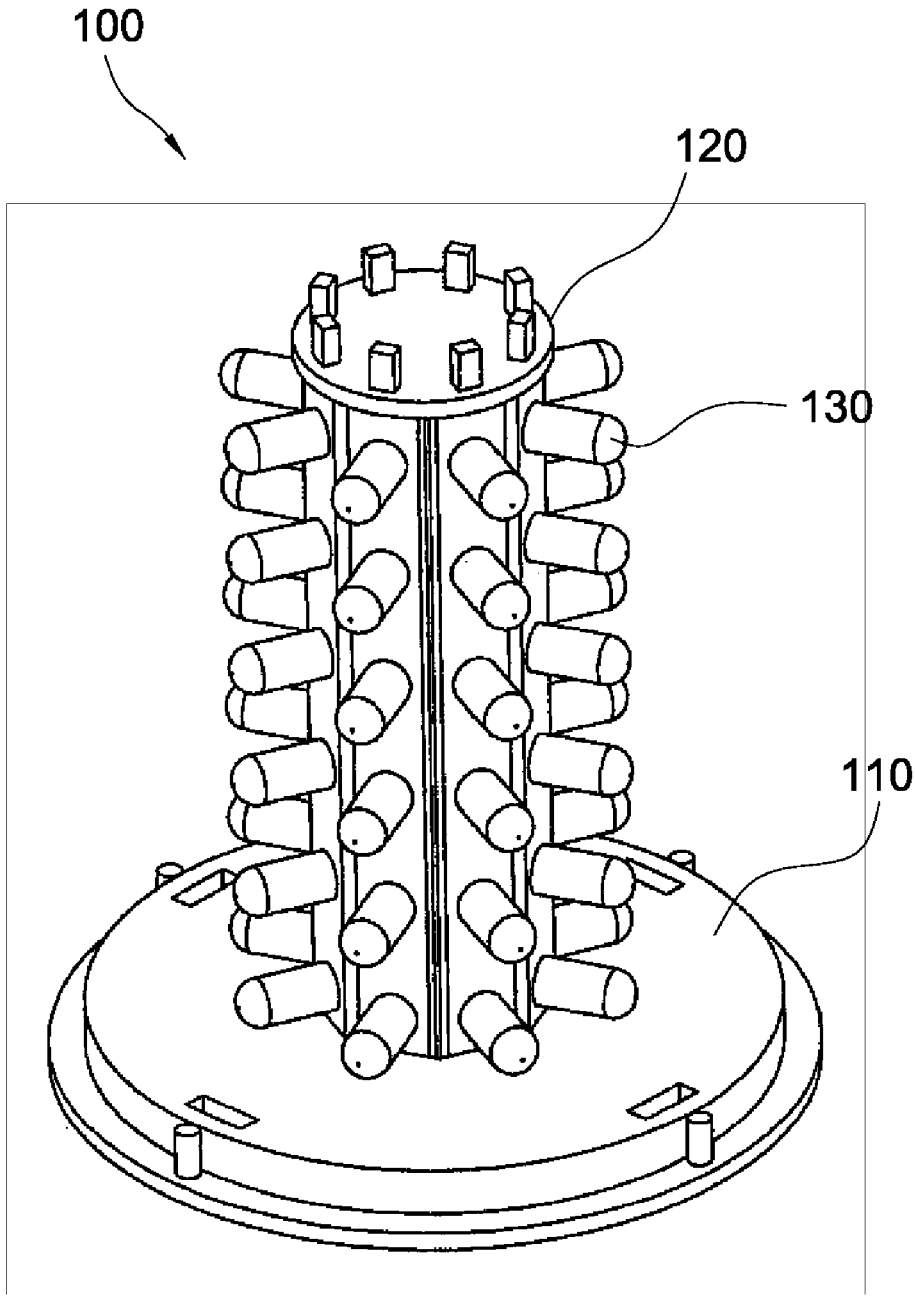
FIG.1 (Prior Art)
FIG. 1 is a perspective view showing the lamp with 360-degree illumination of prior art.
Figure 2:
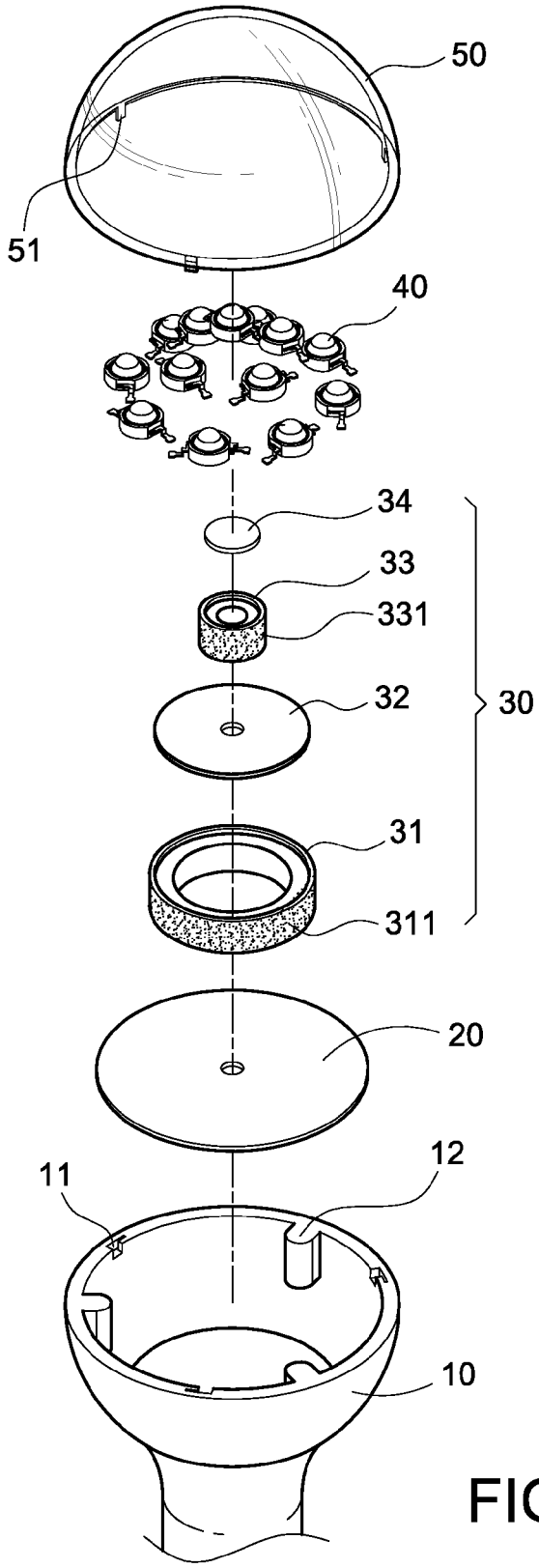
FIG. 2 is an exploded perspective view showing the LED lamp of the present invention.

Please refer to FIG. 2, which is an exploded perspective view of the present invention. The present invention provides a LED lamp with 360-degree illumination, which includes a base 10, a first substrate 20, a stepped structure 30, a plurality of LEDs 40, and a cover 50. Further, a heat sink 60 (not shown in FIG. 2, please refer to FIG. 5) is attached to one surface of the first substrate 20 opposite to the LEDs 40. The heat sink 60 is used to dissipate the heat generated by the whole LED lamp, which will be described later in more detail.

In one embodiment of the present invention, an upper portion of the base 10 and the cover 50 together form a hollow semi-spherical body. The edge of the cover 50 is provided with a plurality of hooks 51. The edge of the base 10 is provided with a plurality of troughs 11 for allowing the hooks 51 to be inserted therein. The base 10 is combined with the cover 50 to form the main body of the LED lamp, and an accommodating space is formed there between.

The first substrate 20 is a metal core printed circuit board (MCPCB) and formed into a circular shape. The first substrate 20 is fixed on the base 10. The inner edge of the base 10 is provided with a plurality of protrusions 12, whereby the first substrate 20 can be soldered or fixed otherwise on the base 10. The diameter of the first substrate 20 is slightly smaller than the inner diameter of the base 10, so that the first substrate 10 will not cover the troughs 11 to hinder the combination of the base 10 with the cover 50.

The stepped structure 30 is mounted on the first substrate 20. The stepped structure 30 includes a first annular frame 31 connected to the first substrate 20, a second substrate 32 connected to the first annular frame 31, and a second annular frame 33 connected to the second substrate 32. The peripheral length of the second annular frame 33 is smaller than that of the first annular frame 31.

Figure 3:
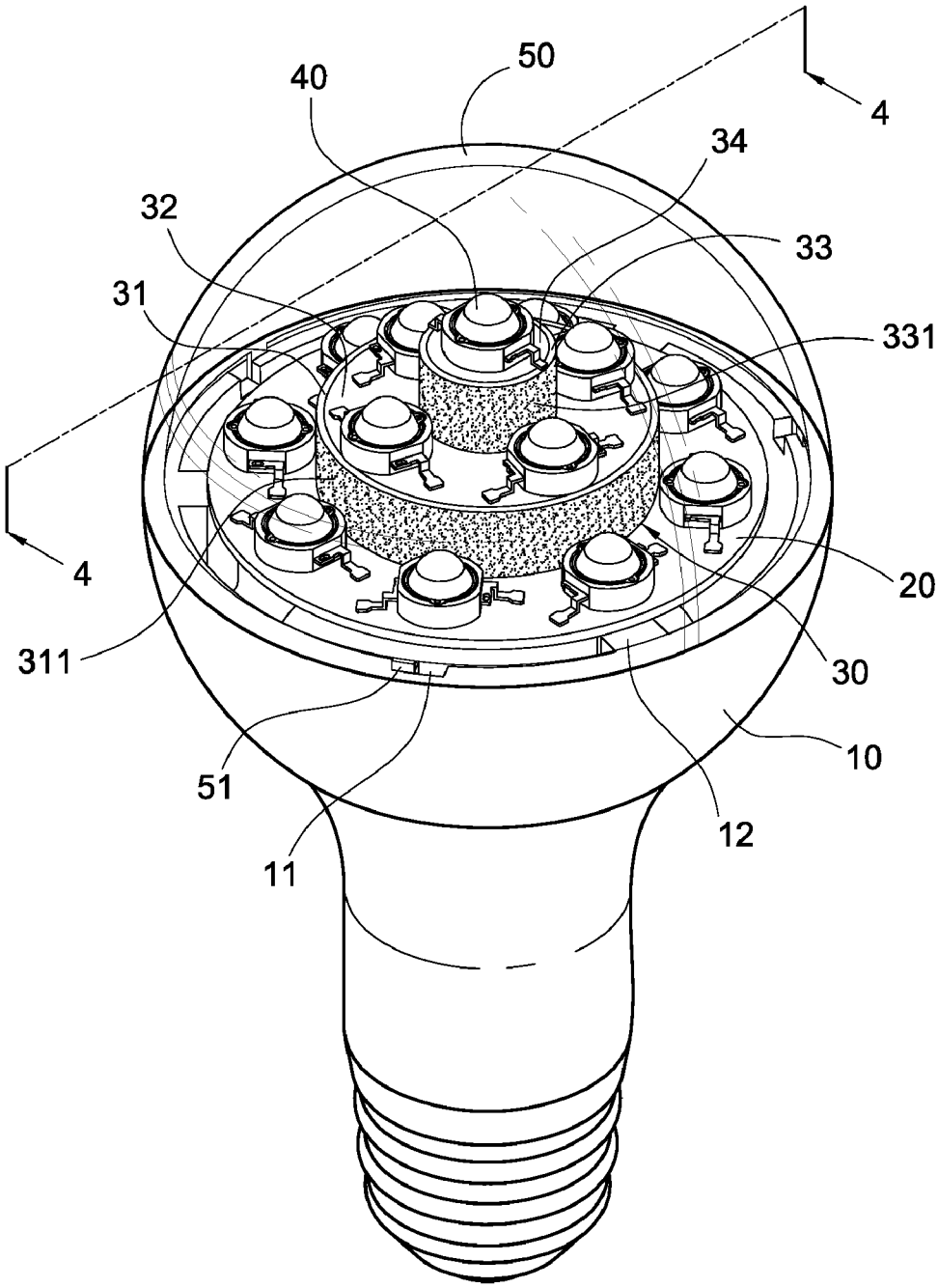
FIG. 3 is an assembled perspective view showing the LED lamp of the present invention.
Figure 4:
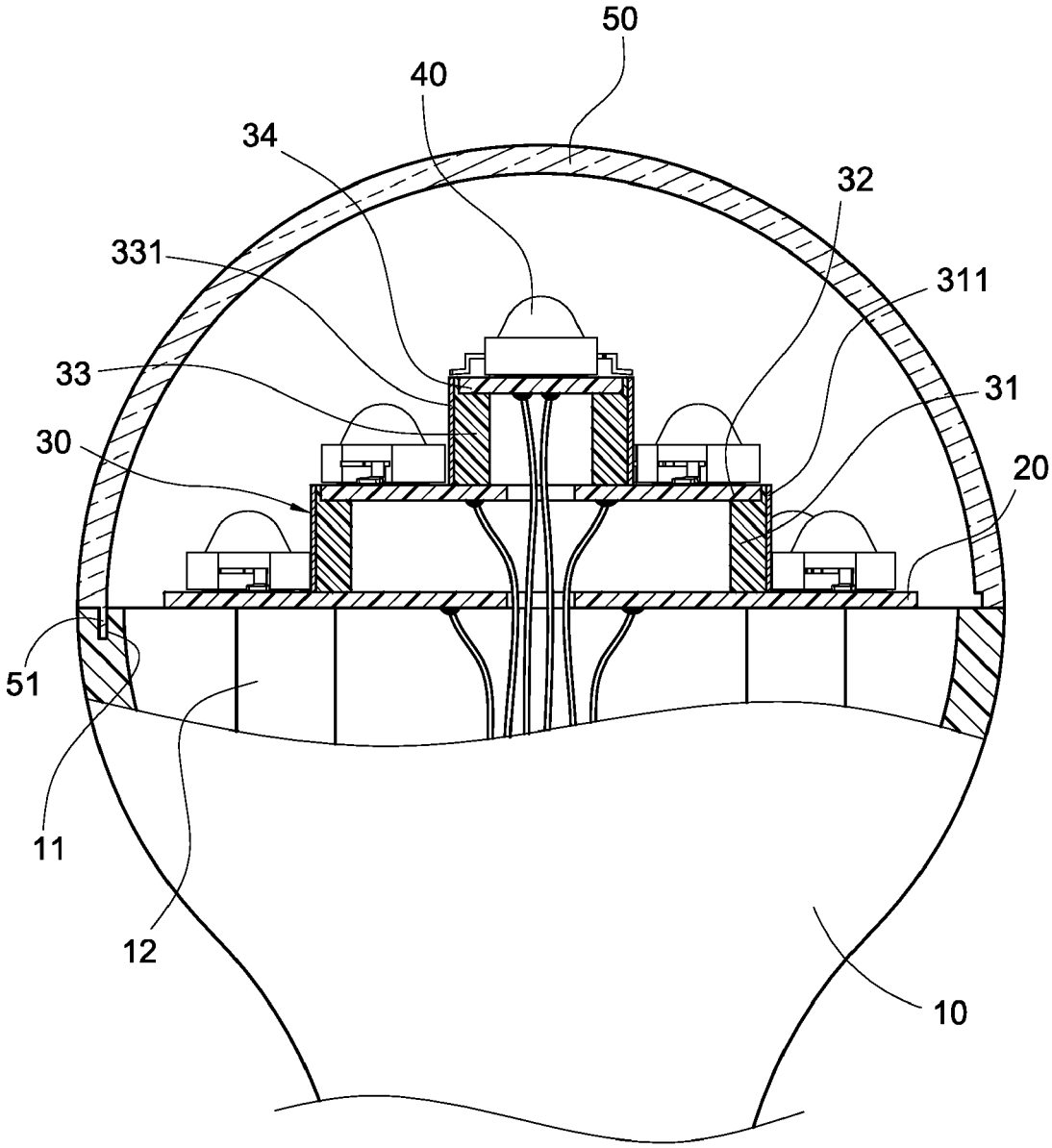
FIG. 4 is a partially cross-sectional view showing the LED lamp of the present invention along the line 4-4 in FIG. 3.

The first annular frame 31 and the second annular frame 33 are made of metallic materials having good thermal conductivity (e.g. Al). The thickness of the wall of the first annular frame 31 or the second annular frame 33 is made larger, thereby increasing the thermal-conducting area. Like the first substrate 20, the second substrate 32 is also a metal core printed circuit board (MCPCB) and formed into a circular shape. In addition, the present embodiment further includes a third substrate 34 connected to the second annular frame 33. Similarly, the third substrate 34 is also a metal core printed circuit board (MCPCB) and formed into a circular shape. The LEDs 40 are fixed on the first substrate 20, the second substrate 32 and the third substrate 34 and surround the first annular frame 31 and the second annular frame 33 respectively. As shown in FIG. 3, the present invention forms a three-storey stepped structure. FIG. 4 is a partially cross-sectional view showing the arrangement inside the present invention.

Figure 5:
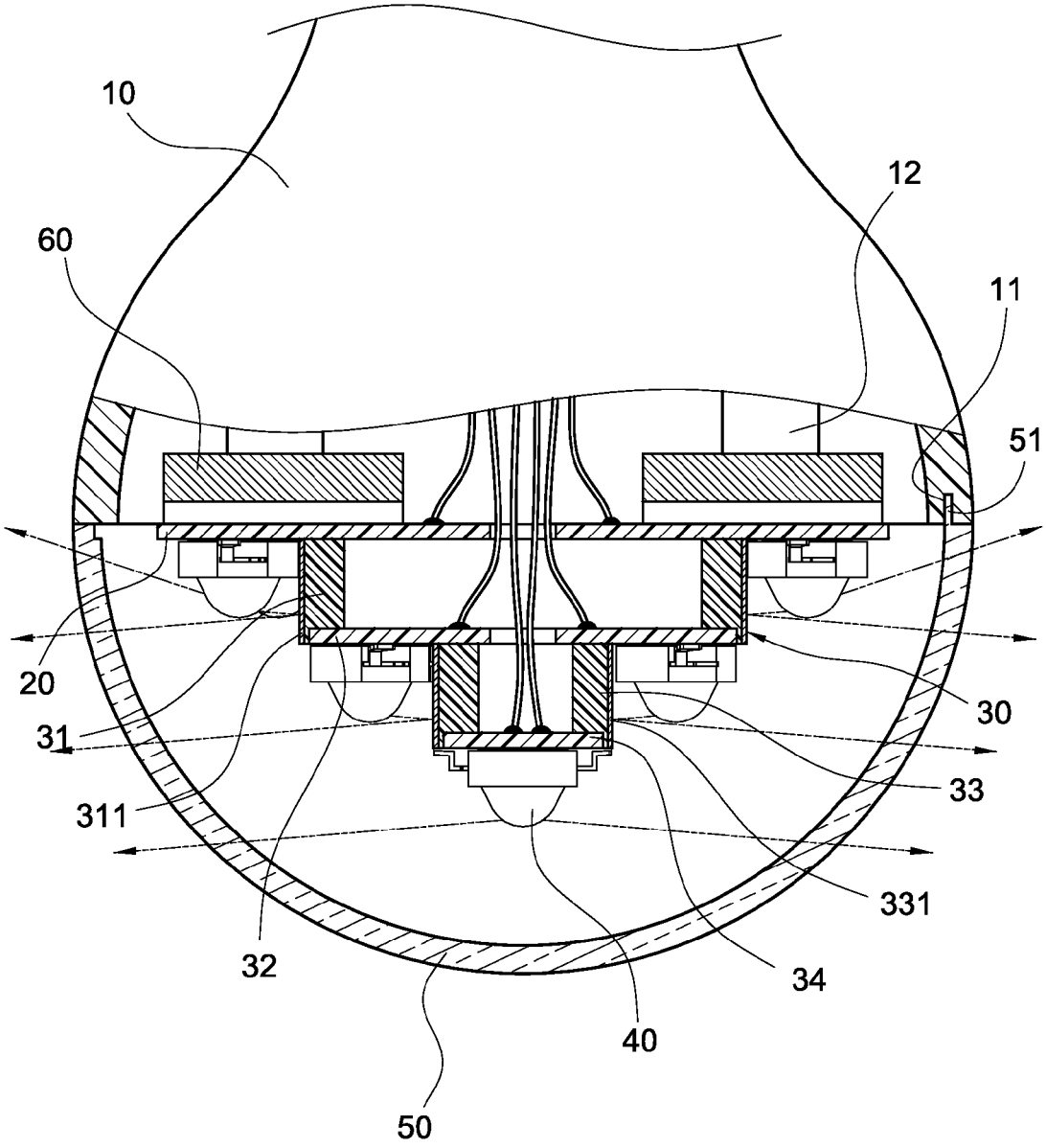
FIG. 5 is a partially cross-sectional view showing the operating state of the LED lamp of the present invention.

Please refer to FIG. 5. The outer surface of the first annular frame 31 is coated with a reflective layer 311, and the outer surface of the second annular frame 33 is coated with a reflective layer 331. The reflective layer 311 and the reflective layer 331 are used to reflect the lights emitted by the LEDs 40. For example, each of the reflective layers 311 and 331 is a coating with mirror polish, but the material thereof is not limited thereto. The lights emitted by the LEDs 40 onto the first substrate 20 can be reflected by the reflecting layer 311 of the adjacent first annular frame 31 toward the outside of the lamp. Similarly, the lights emitted by the LEDs 40 on the second substrate 32 can be reflected by the reflecting layer 331 of the adjacent second annular frame 33 toward the outside of the lamp. Further, no matter the LEDs 40 are surface-emitting LEDs or side-emitting LEDs, the lights emitted by the LEDs 40 can be reflected by the reflective layers 311 and 331 toward the outside of the lamp without being absorbed by the first annular frame 31 and the second annular frame 33. Therefore, the present invention utilizes the reflective layers 311 and 331 to increase the total brightness in the lateral direction of the lamp. In other words, the present invention can achieve the same brightness with a smaller number of LEDs 40. In this way, the production cost and time for assembly can be reduced.

According to the present invention, all of the LEDs 40 are not arranged densely in the same plane, but mounted on the first substrate 20, the second substrate 32 and the third substrate 34 of different heights. Further, the heat generated by the LEDs 40 can be conducted by the first annular frame 31 and the second annular frame 33 to the first substrate 20. In addition, with a heat sink 60 adhered to the other surface of the first substrate 20 and received in the base 10, the heat can be dissipated to the outside. Moreover, the heat sink 60 is formed into a ring to cooperate with the first substrate 20, thereby increasing the heat-dissipating area. Therefore, the present invention can generate a good effect of thermal conduction and heat dissipation.

Figure 6:
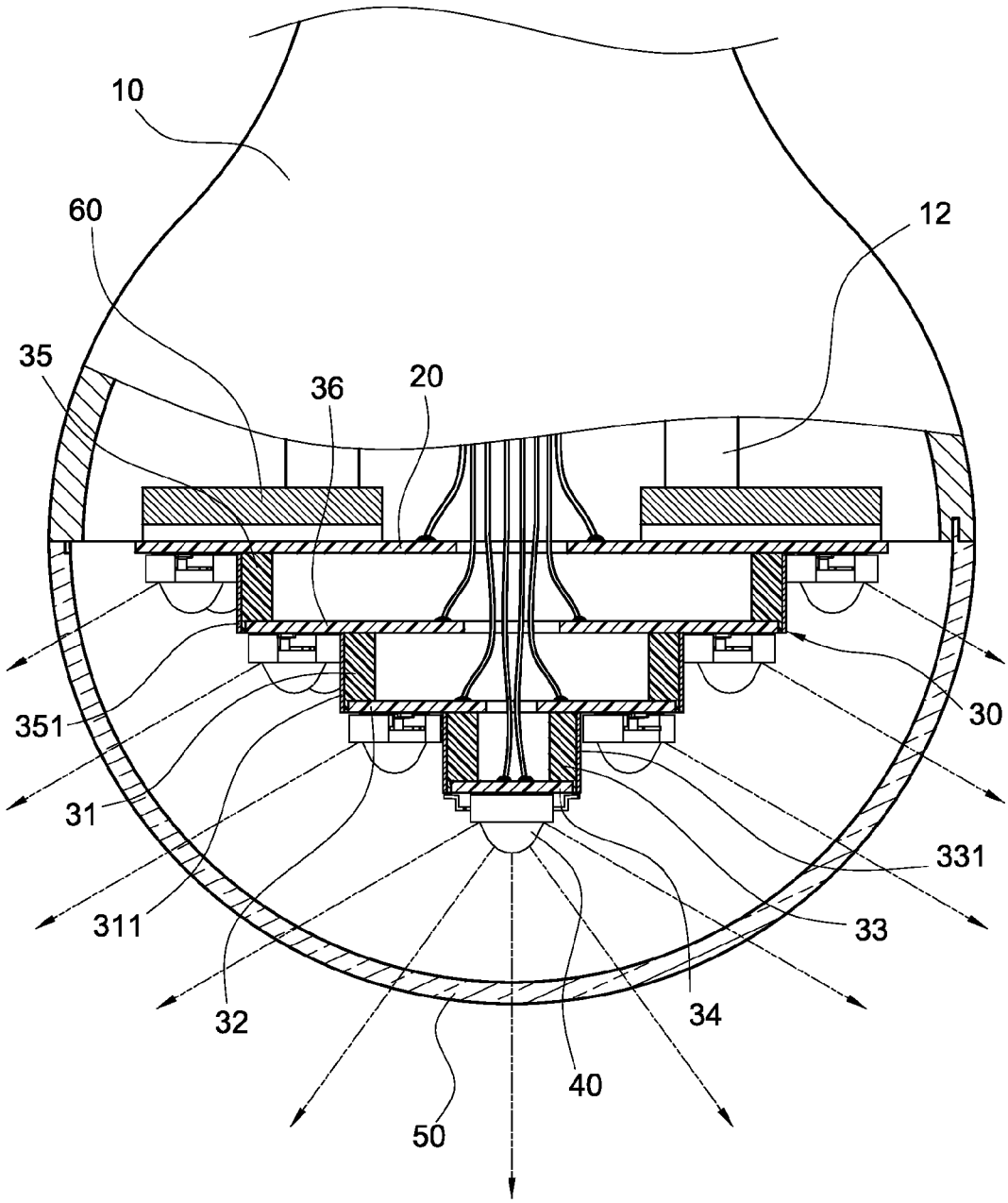
FIG. 6 is a partially cross-sectional view showing the operating state of the LED lamp according to another embodiment of the present invention.

Please refer to FIG. 6, which is another embodiment of the present invention. The difference between the present embodiment and the previous embodiment lies in that: the present embodiment forms a four-storey stepped structure. More specifically, based on the accommodating space between the base 10 and the cover 50 and the size of the LEDs 40, the LEDs 40 can be arranged in a four-storey, or even five-storey stepped structure. FIG. 6 only shows a four-storey stepped structure, which is additionally provided with a third annular frame 35 and a fourth substrate 36 between the first substrate 20 and the first annular frame 31. The outer surface of the third annular frame 35 is also provided with a reflective layer 351. With this arrangement, the LEDs 40 can be arranged in a four-storey stepped structure. It is apparent that such a four-storey stepped structure can provide 360-degree illumination with a more uniform and larger brightness because of the increased number of LEDs 40. Of course, the heat generated by the LEDs 40 can be conducted by the first annular frame 31, the second annular frame 33 and the third annular frame 35 to the first substrate 20. Then, the heat is dissipated to the outside by means of the heat sink 60. Therefore, the present invention can generate a good effect of thermal conduction and heat dissipation.

According to the above, the present invention really demonstrates industrial applicability, novelty and inventive steps. Further, the construction of the present invention has not been seen in products of the same kind or let in public use, so that the present invention conforms to the requirements for a utility model patent.

What is claimed is:

1. A LED lamp with 360-degree illumination, comprising:

a base;

a first substrate fixed on the base;

a stepped structure mounted on the first substrate, the stepped structure having a first annular frame connected to the first substrate, a second substrate connected to the first annular frame, and a second annular frame connected to the second substrate, a peripheral length of the second annular frame being smaller than that of the first annular frame;

a plurality of LEDs fixed to the first substrate and the second substrate and surrounding the first annular frame and the second annular frame respectively; and a cover connected to the base to form an accommodating space there between, and provided with a plurality of hooks, wherein the base is provided with a plurality of troughs for allowing the hooks to be inserted therein.

2. The LED lamp with 360-degree illumination according to claim 1, wherein the LEDs are side-emitting LEDs.

3. The LED lamp with 360-degree illumination according to claim 1, wherein the LEDs are surface-emitting LEDs.

4. The LED lamp with 360-degree illumination according to claim 1, wherein outer surfaces of the first annular frame and the second annular frame are provided with a reflective layer respectively for reflecting the lights emitted by the LEDs.

5. The LED lamp with 360-degree illumination according to claim 4, further comprising a third substrate connected to the second annular frame, another LED being fixed onto the third substrate.

6. The LED lamp with 360-degree illumination according to claim 1, wherein an inner edge of the base is provided with a plurality of protrusions for allowing the first substrate to be fixed thereto.

7. The LED lamp with 360-degree illumination according to claim 1, further comprising a heat sink provided in the base and brought in thermal contact with one surface of the first substrate.

8. A LED lamp with 360-degree illumination, comprising:

a base;

a first substrate fixed on the base;

a stepped structure mounted on the first substrate, the stepped structure having a first annular frame connected to the first substrate, a second substrate connected to the first annular frame, and a second annular frame connected to the second substrate, a peripheral length of the second annular frame being smaller than that of the first annular frame;

a plurality of LEDs fixed to the first substrate and the second substrate and surrounding the first annular frame and the second annular frame respectively, wherein an arrangement of the base, the first substrate, the first annular frame, the second substrate and the second annular frame is sequential along a direction of light radiation of the LEDs.

9. The LED lamp with 360-degree illumination according to claim 8, wherein an inner edge of the base is provided with a plurality of protrusions for allowing the first substrate to be fixed thereto.

10. The LED lamp with 360-degree illumination according to claim 8, further comprising a heat sink provided in the base and brought in thermal contact with one surface of the first substrate.

11. The LED lamp with 360-degree illumination according to claim 8, wherein the LEDs are side-emitting LEDs.

12. The LED lamp with 360-degree illumination according to claim 8, wherein the LEDs are surface-emitting LEDs.

13. The LED lamp with 360-degree illumination according to claim 8, wherein outer surfaces of the first annular frame and the second annular frame are provided with a reflective layer respectively for reflecting the lights emitted by the LEDs.

14. The LED lamp with 360-degree illumination according to claim 13, further comprising a third substrate connected to the second annular frame, another LED being fixed onto the third substrate.

15. The LED lamp with 360-degree illumination according to claim 8, further comprising a cover connected to the base to form an accommodating space there between.

16. The LED lamp with 360-degree illumination according to claim 15, wherein the cover is provided with a plurality of hooks, and the base is provided with a plurality of troughs for allowing the hooks to be inserted therein.

* * * * *